US005396316A

United States Patent [19]

Smith

[11] Patent Number: 5,396,316

[45] Date of Patent: Mar. 7, 1995

[54] USER-REPLACEABLE LIQUID TONER CARTRIDGE WITH INTEGRAL PUMP AND VALVE MECHANISMS

[75] Inventor: David L. Smith, Meridian, Id.

[73] Assignee: Hewlett-Packard Company, Palo Alto, Calif.

[21] Appl. No.: 139,956

[22] Filed: Oct. 20, 1993

[51] Int. Cl.[6] ..... G03G 15/10

[52] U.S. Cl. ..... 355/256; 354/324; 355/200

[58] Field of Search ..... 355/256, 200; 354/324

[56] References Cited

U.S. PATENT DOCUMENTS

| | | | |
|---|---|---|---|
| 3,062,123 | 11/1962 | Limberger | 354/324 X |
| 3,601,029 | 8/1971 | Needleman | 354/324 |
| 3,650,196 | 3/1972 | Hosoe et al. | 354/324 |
| 3,868,715 | 2/1975 | Slavin | 354/324 |
| 4,398,818 | 8/1983 | Jeromin et al. | 355/256 |
| 4,968,998 | 11/1990 | Allen | 346/140 R |

*Primary Examiner*—Fred L. Braun

[57] ABSTRACT

A user-replaceable liquid toner cartridge fits into a receptacle in an EP printer. The receptacle includes automatic fluid and mechanical connectors that mate with the cartridge upon its insertion. The cartridge includes a liquid toner supply reservoir, a pump connected to an outlet from the reservoir; a mechanical coupling that automatically engages a pump actuator that extends from the receptacle; and a three-port valve. The three-port valve is connected to an output from the pump and has a first port that communicates with the reservoir and a second port that communicates with an external wall of the cartridge. The fluid connector automatically connects to a fluid fitting in the receptacle upon insertion of the cartridge. The fluid fitting in the receptacle also automatically operates the valve in the cartridge and redirects liquid toner flow from a recirculation path to the cartridge's reservoir and directs it into the receptacle's fluid fitting.

11 Claims, 4 Drawing Sheets

USER-REPLACEABLE LIQUID TONER CARTRIDGE WITH INTEGRAL PUMP AND VALVE MECHANISMS

FIELD OF THE INVENTION

This invention relates to electrophotographic (EP) printing and, more particularly, to a user-replaceable liquid toner cartridge for an EP printer.

BACKGROUND OF THE INVENTION

To maintain costs as low as possible, EP printers are now designed to allow as much user maintenance as possible. To this end, dry toner EP printers enable a user to replace the toner cartridge which also contains an entirely new organic photoconductor-coated drum and related actuating mechanisms. EP printers which employ liquid toners are provided with refillable toner reservoirs, thus requiring the user to replenish the in-printer reservoir from a liquid toner supply. The user is thus exposed to possible spillage, vapors, and, with color printers, the possibility that a wrong color toner will be loaded into a reservoir.

Because liquid toners contain toner particles in a liquid carrier, the particles may settle to the bottom of the toner container unless provisions are made to either agitate the liquid toner or to provide means for its continuous circulation. Prior art printers have included liquid toner pumps and valve mechanisms for the recirculation of the liquid toner. Since such pumps and valves were part of the printer, their reliability was required to be equal to that of the printer. However, over a period of time, the liquid toner was found to coat the internal surfaces of the pump and valve mechanisms with a paint-like substance that eventually impaired their working parts.

Accordingly, it is an object of this invention to provide an improved, user-replaceable, liquid toner cartridge for an EP printer.

It is another object of this invention to provide an improved, user-replaceable, liquid toner cartridge which requires only two fluid connections.

It is yet another object of this invention to provide an improved, user-replaceable, liquid toner cartridge that incorporates mechanisms that are likely to fail prior to the end of the useful life of the printer.

It is still another object of this invention to provide a user-replaceable toner cartridge wherein all connections to the cartridge are automatically made upon insertion of the cartridge into a printer.

SUMMARY OF THE INVENTION

A user-replaceable liquid toner cartridge fits into a receptacle in an EP printer. The receptacle includes automatic fluid and mechanical connectors that mate with the cartridge upon its insertion. The cartridge includes a liquid toner supply reservoir, a pump connected to an outlet from the reservoir; a mechanical coupling that automatically engages a pump actuator that extends from the receptacle; and a three-port valve. The three-port valve is connected to an output from the pump and has a first port that communicates with the reservoir and a second port that communicates with an external wall of the cartridge where it connects to a fluid fitting in the receptacle upon insertion of the cartridge. The fluid fitting in the receptacle also automatically operates the valve in the cartridge and redirects liquid toner flow from a recirculation path to the cartridge's reservoir and directs it into the receptacle's fluid fitting.

DETAILED DESCRIPTION OF THE INVENTION

Figure 1:
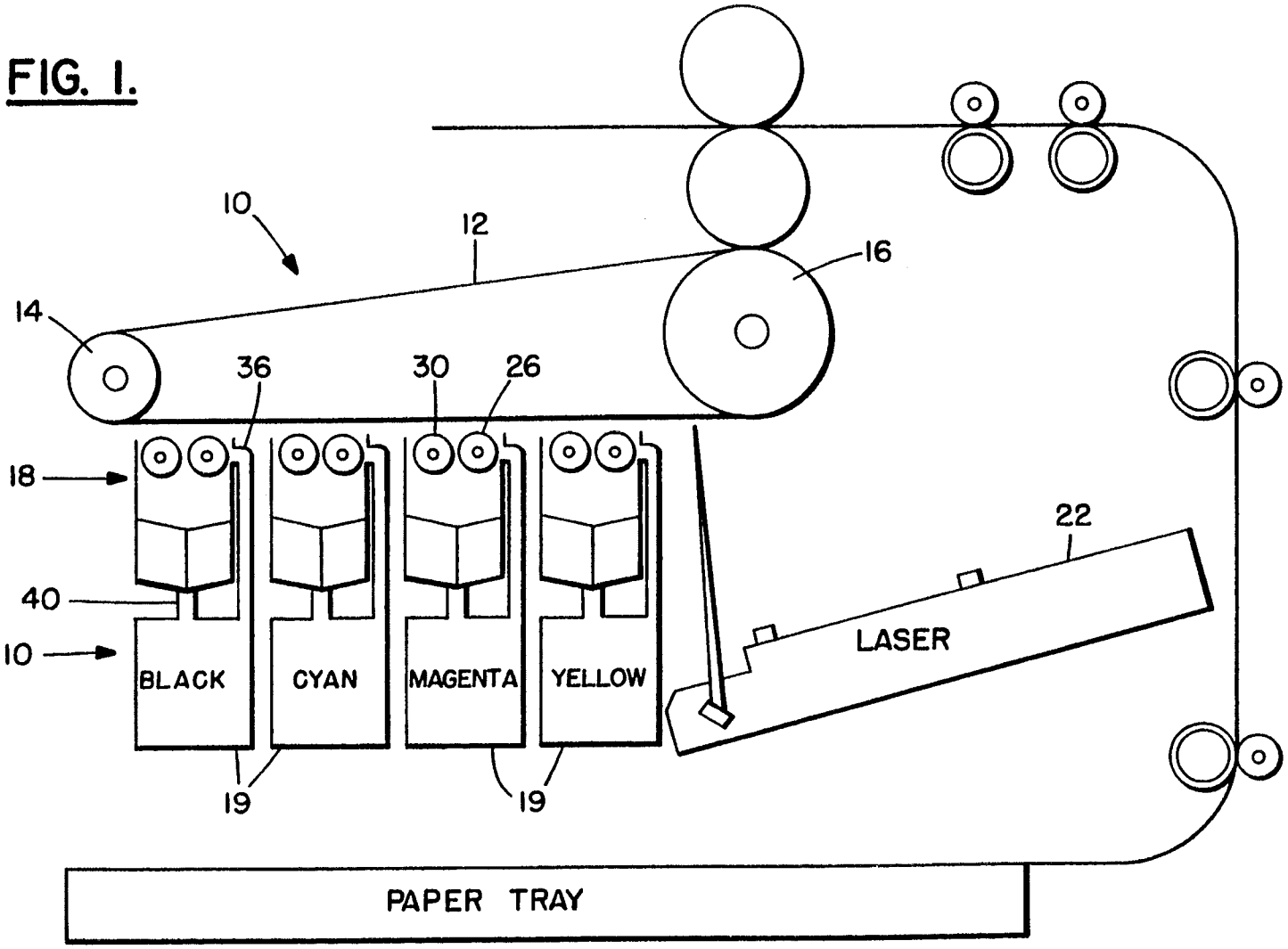
FIG. 1 is a schematic side view,of a color EP printer.

The schematic view of FIG. 1 illustrates the main elements of a color EP printer 10. An organic photoconductor (OPC) belt 12 is positioned on rollers 14 and 16 and is movable past a plurality of developer chambers 18. Each developer chamber 18 is respectively connected to a toner reservoir 19 to thereby enable the respectively connected developer chamber 18 to apply a particular color toner to an imaged portion of OPC belt 12.

Laser 22 images OPC belt 12 just prior to its passage over developer chambers 18. One developer chamber 18 is then controlled to apply a liquid-toner color to the exposed regions on OPC belt 12. A developer chamber 18 includes at least a developer roller 26 and a squeegee roller 30. A toner supply line 36 is connected to a liquid toner reservoir 19. Liquid toner makes contact with developer roller 26 which, in turn, applies the toner to imaged areas of OPC belt 12. Squeegee roller 30 removes excess toner. Used liquid toner falls to the bottom of a developer chamber 18 where it is carried back to a liquid toner reservoir 19 through a feed line 40.

Figure 2:
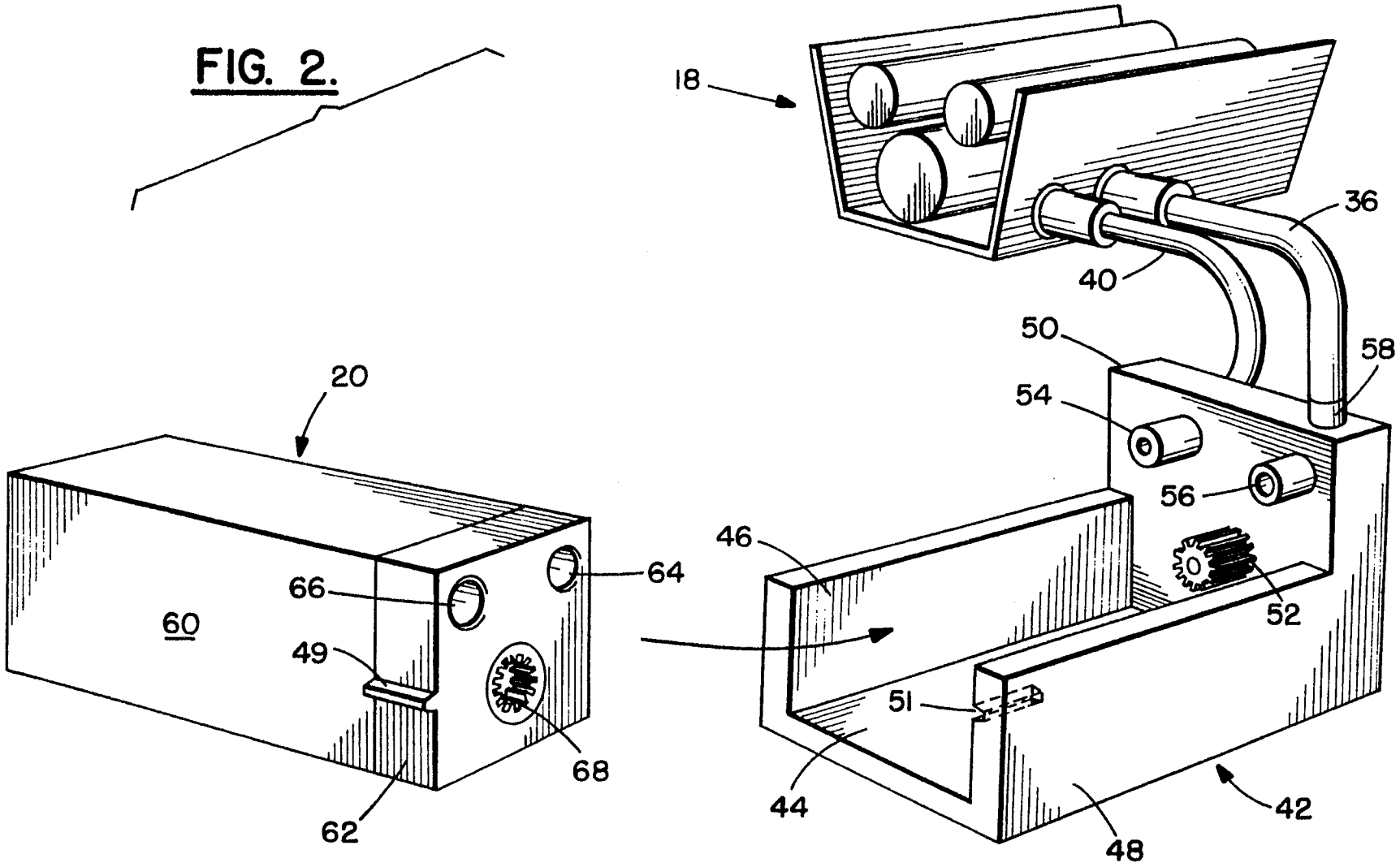
FIG. 2 is a perspective view of a replaceable liquid toner cartridge and a receptacle for receiving the cartridge.

FIG. 2 is a schematic view of a replaceable liquid toner cartridge 20 and a cartridge receptacle 42. Cartridge receptacle 42 includes a base plate 44 and a pair of upwardly extending walls 46 and 48. A rear wall 50 includes a pump actuator 52, a fluid coupling 54 that is connected to used toner feed line 40, and a fluid connector 56 which communicates with toner inlet line 36 through coupling 58.

Liquid toner cartridge 20 comprises a reservoir 60 and a front-mounted face plate 62. Positioned in face plate 62 is a female fluid fitting 64 that mates with an outlet fluid coupling 54 in receptacle 42. A further female opening 66 enables an inlet fluid coupling 56 to pass through face plate 62 and make connection with a three-port valve mounted in an end wall of reservoir 60. This structure will be further considered during the description of FIGS. 4 an 4A. A female gear 68 is mounted for rotation in face plate 62 and mates with gear actuator 52 in cartridge receptacle 42. Female gear 68 operates a gear pump which is positioned behind face plate 62 in the end wall of reservoir 60.

When a user inserts a replacement liquid toner cartridge 20 into cartridge receptacle 42, walls 46, 48 and base plate 44 assure proper mating between outlet fluid coupling 54 and inlet receptacle 64, inlet fluid coupling 56 and female opening 66 and gear actuator 52 with female gear 68. Not shown in FIG. 2 is a user-operated clip which engages the rear portion of cartridge 20 to maintain it in place in receptacle 42. To prevent incorrect insertion of a wrong toner cartridge 20 into receptacle 42, a key 49 is formed into a side of toner cartridge 20 and mates with a keyway 51 in receptacle 42. Each color type cartridge 20 has its key placed so as to only mate with a keyway in a receptacle 42 that is to receive the particular color. As shown in FIG. 1, the four reservoirs 19 are, in actuality, four cartridge receptacles 42 for receiving liquid toner cartridges 20, each including a different color liquid toner. In each case, cartridge receptacle 42 makes fluid connections to an associated developer chamber 18.

Figure 3:
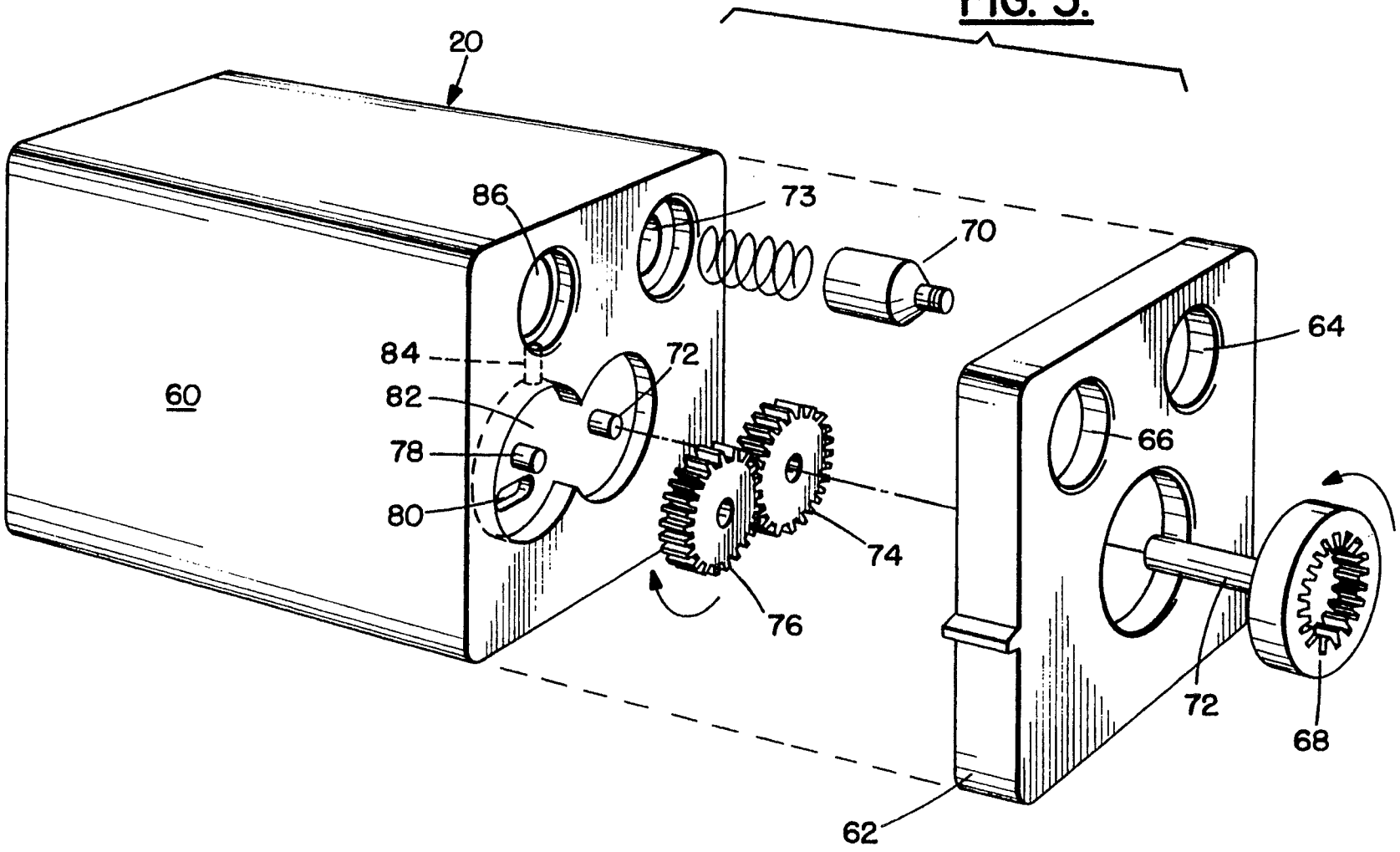
FIG. 3 is a partially exploded view of the liquid toner cartridge.

FIG. 3 is a partially exploded view of liquid toner cartridge 20 showing face plate 62 separated from toner reservoir 60. As indicated above, female fitting 64 receives outlet fluid coupling 54 which carries used toner from a developer chamber 18. A spring loaded plunger 70 provides a seal within fitting 64 except when fluid coupling 54 is present therein. Under such circumstances, plunger 70 is forced backwardly, causing a valve 73 to be opened which communicates with reservoir 60. Thus, when fluid coupling 54 is present in fitting 64, a return flow path into reservoir 60 is available for used toner.

Female gear 68 is connected via a shaft 72 to a gear 74 which, in turn, drives a pump gear 76. A channel 80 communicates with reservoir 60 and enables toner to flow into recessed area 82 about pump gear 76. Rotation of pump gear 76 causes the toner to be driven upwardly into channel 84, where it communicates with a three-port valve 86 whose details are shown in FIG. 4.

When fluid coupling 56 passes through opening 66 and makes contact with three-port valve 86, valve 86 is actuated to provide a toner outflow channel into fluid coupling 56. When fluid coupling 56 is not present in opening 66, two way valve 86 causes the toner being pumped through channel 84 to be fed back into reservoir 60 so as to achieve a continuous recirculation action.

Figures 4, 4A:
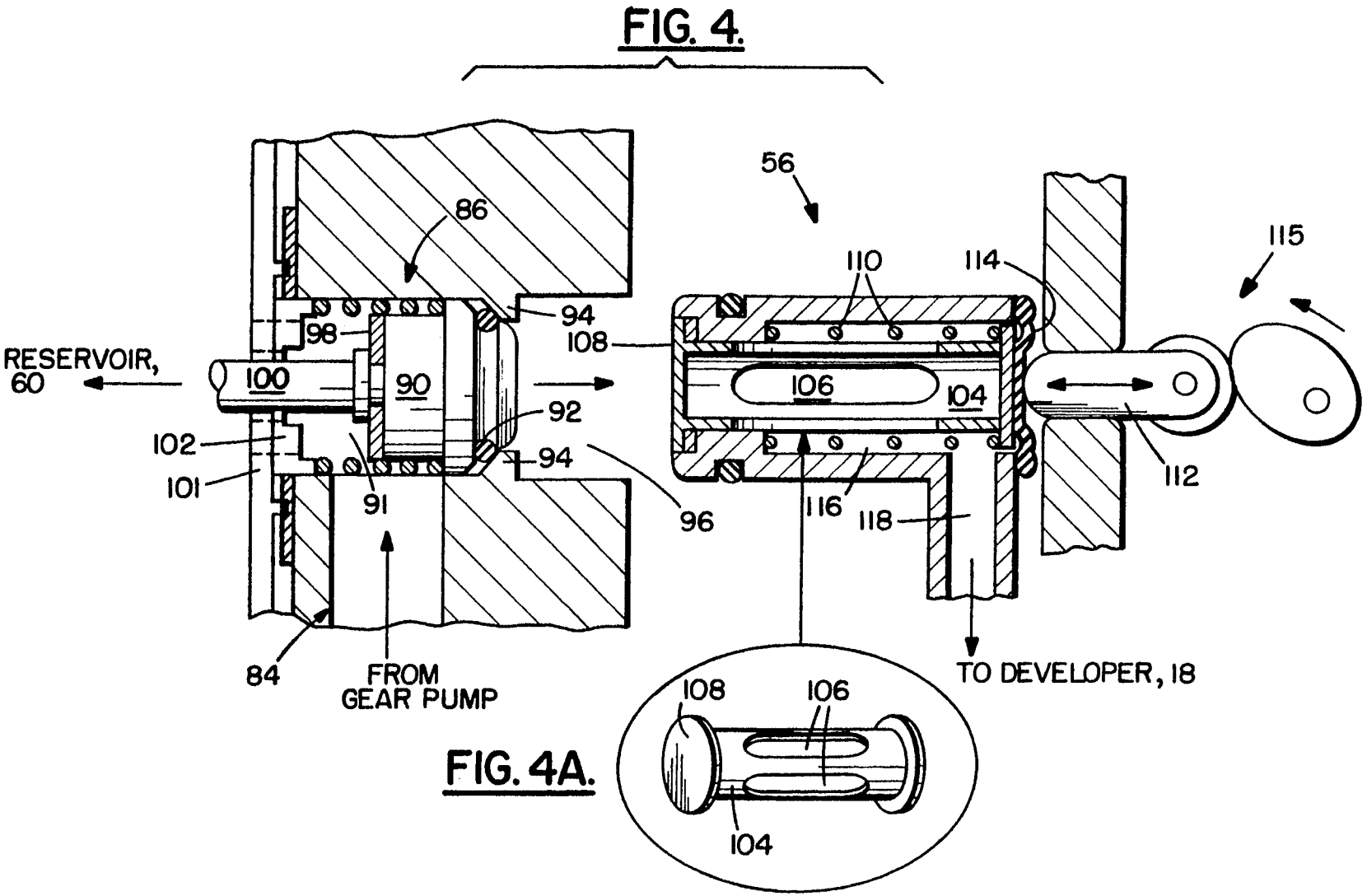
FIG. 4 is a sectional view showing a fluid interconnection mechanism between the liquid toner cartridge and a receptacle.
FIG. 4A is a perspective view of an actuating member that forms part of the fluid interconnection mechanism of FIG. 4.

In FIG. 4, details are shown of three-port valve 86 and inlet fluid coupling 56. Three-port valve 86 includes a valve member 90 that is movably mounted in channel 91 and spring biased to force an O-ring 92 against inset portions 94 of recess 96. A resilient flange 98 is positioned on the posterior portion of valve member 90 and is held in place by a guidepost 100. A rear plate member 101 includes openings 102 which communicate with reservoir 60. In the position shown in FIG. 4, liquid toner from gear pump 76 flows upwardly through channel 84 and to the left through rear plate member 101, openings 102 and into reservoir 60.

Inlet fluid coupling 56 includes an apertured actuating member 104 that is shown in perspective in FIG. 4A. Apertured actuating member 104 includes apertures 106 which communicate with a hollow interior of actuating member 104. End portion 108 abuts valve member 90 when fluid coupling 56 is inserted into recess 96. A spring 110 biases apertured actuating member 104 into a right-most rest position until it is moved to the left by movement of a shaft 112 that causes flexure of resilient sealing member 114. The operation of shaft 12 is controlled by a cam/follower mechanism 115 which is selectively powered from the main printer motor in printer 10.

Initially, when fluid coupling 56 is inserted into recess 96, apertured actuating member 104 has no effect upon valve member 90. In such case, liquid toner from gear pump 76 continues to flow back into reservoir 60. However, upon actuation of shaft 112 to the left by cam/follower mechanism 115, apertured actuating member 104 is moved to the left and bearing portion 108 causes a leftward movement of valve member 90. The leftward movement of valve member 90 causes resilient washer 98 to seal inlets 102 to reservoir 60. The movement of valve member 90 also opens a pathway from channel 84 through apertures 106 (in apertured actuating member 104), into surrounding region 116 and through channel 118 towards a developer chamber 18. Through this action.: three-port valve 86 is actuated by fluid coupling 56 which also provides an inlet pathway for flow of liquid toner to an associated developer chamber 18. Otherwise, liquid toner recirculates into reservoir 60, to prevent sedimentation.

As can be seen from the above, liquid toner cartridge 20 requires only two fluid couplings and a single pump actuation inlet. While a geared pump is shown in the drawings, other types of pumps can be substituted therefor, e.g., a diaphragm pump wherein the diaphragm is operated by an impelling member mounted in cartridge receptacle 42. The above described structure enables the pumps and valves contained with liquid toner cartridge 20 to be tailored to match the requirements of the specific toner fluid being pumped. During recirculation, when the toner liquid is pumped without imaging, all toner fluid remains internal to the cartridge. A single, continuously operating motor can thus be used to drive all the pumps in all cartridges. Both pump and valve mechanisms may be constructed less expensively as their lifetimes can be made equivalent to the expected usage time of a liquid toner cartridge. Finally, virtually all of the toner is refreshed when a new cartridge is inserted.

It should be understood that the foregoing description is only illustrative of the invention. Various alternatives and modifications can be devised by those skilled in the art without departing from the invention. While the invention has been described in the context of a color EP printer, it is equally usable in a black/white EP printer or in any other mechanism which requires a pumped, liquid toner supply. Accordingly, the present invention is intended to embrace all such alternatives, modifications and variances which fall within the scope of the appended claims.

What is claimed is:

1. A replaceable liquid toner cartridge for an electrophotographic (EP) apparatus, said EP apparatus including a receptacle for receiving said liquid toner cartridge and including at least fluid connection means and a pump operating means, said liquid toner cartridge comprising:

a reservoir for holding a supply of liquid toner;

pump means having an input connected from said reservoir, an output and means for engaging said pump operating means upon insertion of said cartridge into said receptacle; and valve means connected to said output from said pump means and having a first valve output communicating with said reservoir to enable recirculation of toner liquid from said pump means to said reservoir, and a second valve output in communication with an external wall of said cartridge for making connection with said fluid connection means to enable a feeding of said liquid toner to said EP apparatus when said cartridge is inserted into said receptacle.

2. The liquid toner cartridge as recited in claim 1 wherein said fluid connection means comprises an inlet fluid coupling and an outlet fluid coupling, said outlet fluid coupling providing used liquid toner fluid, said liquid toner cartridge further comprising:

inlet port means communicating with said reservoir and positioned to mate with said outlet fluid coupling when said cartridge is positioned in said receptacle.

3. The liquid toner cartridge as recited in claim 2, wherein said valve means comprises:

a first liquid channel connecting said first and second valve outputs;

a second liquid channel connecting said output from said pump means to said first liquid channel; and a movable valve member mounted in said first liquid channel, said valve member spring biased to enable liquid toner flow from said second liquid channel to said first valve output and responsive to external actuation to move against said spring bias to enable a liquid toner flow from said second liquid channel to said second valve output.

4. The liquid toner cartridge as recited in claim 3 and including an external casing that mates with said receptacle so as to align said inlet and outlet fluid couplings and pump operating means with said valve means, inlet port means, and pump means, respectively.

5. The liquid toner cartridge as recited in claim 1 wherein said fluid connection means includes movable actuating means for operating said valve means, said valve means responsive to a first position of said movable actuating means to direct liquid toner flow from said pump means to said first valve output, and responsive to a second position of said movable actuating means to direct liquid toner flow from said pump means to said second valve output.

6. The liquid toner cartridge as recited in claim 1 wherein said fluid connection means includes a movable actuating means, said movable actuating means linearly movable to displace a valve member in said valve means to close a channel between said output of said pump means and said reservoir and to open a channel between said output of said pump means and a channel in said fluid connection means which communicates with a developer mechanism in said EP apparatus.

7. An electrophotographic (EP) apparatus which employs a liquid toner in an EP process, said EP apparatus comprising:

at least one receptacle for receiving a liquid toner cartridge, said receptacle including a used toner coupling, a new toner coupling, and pump actuating means; and a removable liquid toner cartridge, including a reservoir for holding a supply of liquid toner, inlet port means communicating with said reservoir and positioned to mate with said used toner coupling when said cartridge is positioned in said receptacle, pump means having an input from said reservoir, an output, and means for engaging said pump actuating means upon insertion of said cartridge into said receptacle, and valve means connected to said output from said pump means and having a first valve output communicating with said reservoir to enable recirculation of toner liquid from said pump means to said reservoir, and a second valve output in communication with an external wall of said cartridge, said second valve output for making connection with said new toner coupling and feeding liquid toner to said EP apparatus when said cartridge is inserted into said receptacle.

8. The EP apparatus as recited in claim 7, wherein said valve means comprises:

a first liquid channel connecting said first and second valve outputs;

a second liquid channel connecting said output from said pump means to said first liquid channel; and a movable valve member mounted in said first liquid channel , said valve member spring biased to enable liquid toner flow from said second liquid channel to said first valve output and responsive to actuation by insertion of said new toner coupling to move against said spring bias to enable liquid toner flow from said second liquid channel to said new toner coupling.

9. The EP apparatus as recited in claim 8 wherein said pump actuating means comprises a rotary driver that actuates said means for engaging upon insertion of said removable liquid cartridge into said receptacle.

10. The EP apparatus as recited in claim 9 wherein said used toner coupling is connected to a fluid channel which receives used toner from a developer, and said new toner coupling is connected via a fluid channel to said developer for providing a supply of toner thereto.

11. The EP apparatus as recited in claim 10 further comprising a plurality of receptacles for receiving liquid toner cartridges, each receptacle fluid connected to a different color developer and for receiving a different color-containing liquid toner cartridge.

* * * * *